United States Patent [19]

Alvi

[11] Patent Number: 4,522,089

[45] Date of Patent: Jun. 11, 1985

[54] TEST TUBE CAP REMOVER

[76] Inventor: Javid R. Alvi, 7970 Larwin Dr., Citrus Heights, Calif. 95610

[21] Appl. No.: 546,237

[22] Filed: Oct. 28, 1983

[51] Int. Cl.[3] ..... B67B 7/02

[52] U.S. Cl. ..... 81/3.42; 53/109; 53/381 A

[58] Field of Search ..... 81/3.1 R, 3.34, 3.36, 81/3.4, 3.41, 3.42, 3.44, 3.38; 53/109, 492, 319, 381 A

[56] References Cited

U.S. PATENT DOCUMENTS

| | | | |
|---|---|---|---|
| 297,389 | 4/1884 | Hannan | 81/3.1 R |
| 893,055 | 7/1908 | Conner | 81/3.41 |
| 1,213,452 | 1/1917 | Brady | 81/3.41 |
| 1,294,820 | 2/1919 | Middleton | 53/109 |
| 1,596,960 | 8/1926 | Becchetti | 81/3.4 |
| 2,718,801 | 9/1955 | Finley | 81/3.41 |
| 3,037,408 | 6/1962 | Rives et al. | 81/3.42 |
| 3,262,247 | 7/1966 | Scholle | 81/3.34 |
| 3,377,775 | 4/1968 | Mattimoe et al. | 53/109 |
| 3,638,515 | 2/1972 | Lentz | 81/3.1 R |
| 3,785,225 | 1/1974 | McKenna | 81/3.1 R |
| 3,837,242 | 9/1974 | Harper | 81/3.1 R |
| 3,919,901 | 11/1975 | Braman | 81/3.4 |
| 4,217,798 | 8/1980 | McCarthy et al. | 53/381 A |
| 4,446,674 | 5/1984 | Inada | 53/381 A |

*Primary Examiner*—Roscoe V. Parker

*Attorney, Agent, or Firm*—Lothrop & West

[57] ABSTRACT

A device for removing a cap from a test tube under sanitary conditions has an enclosure receiving at least part of the test tube and cap and isolating them from the atmosphere. A plunger reciprocable in a cylinder sealed to the enclosure can be hand operated to close normally spread gripper members against the cap flange and to pull the so-gripped cap from the tube. Any discharge from the just-opened tube is confined within the enclosure. The uncapped tube can be removed from the enclosure, and the cap also can be removed for reuse.

10 Claims, 4 Drawing Figures

FIG-1
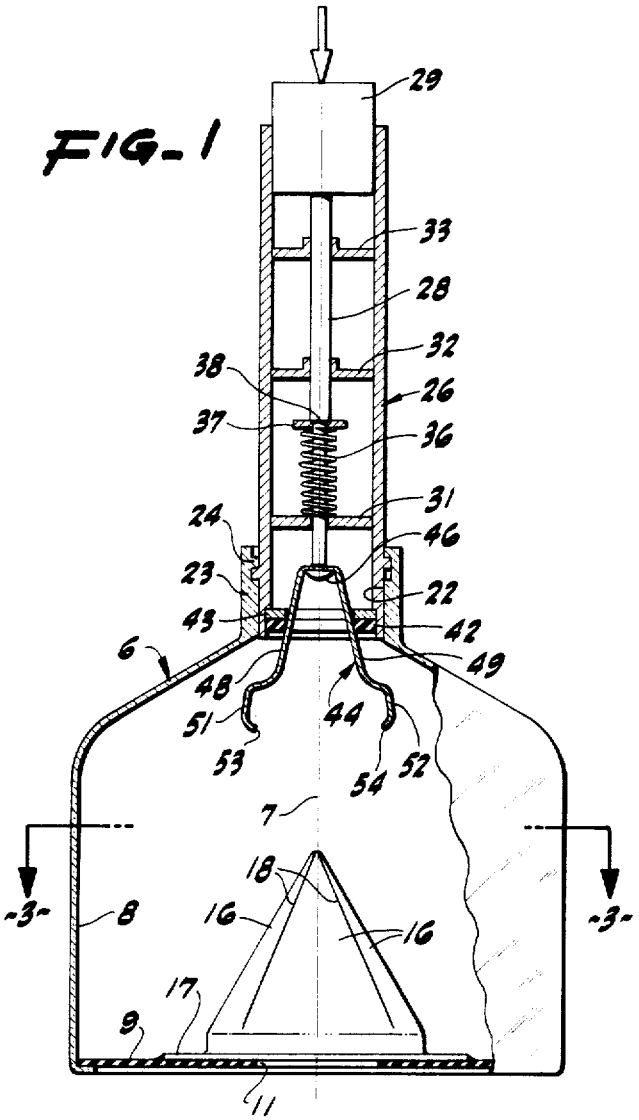
FIG-2
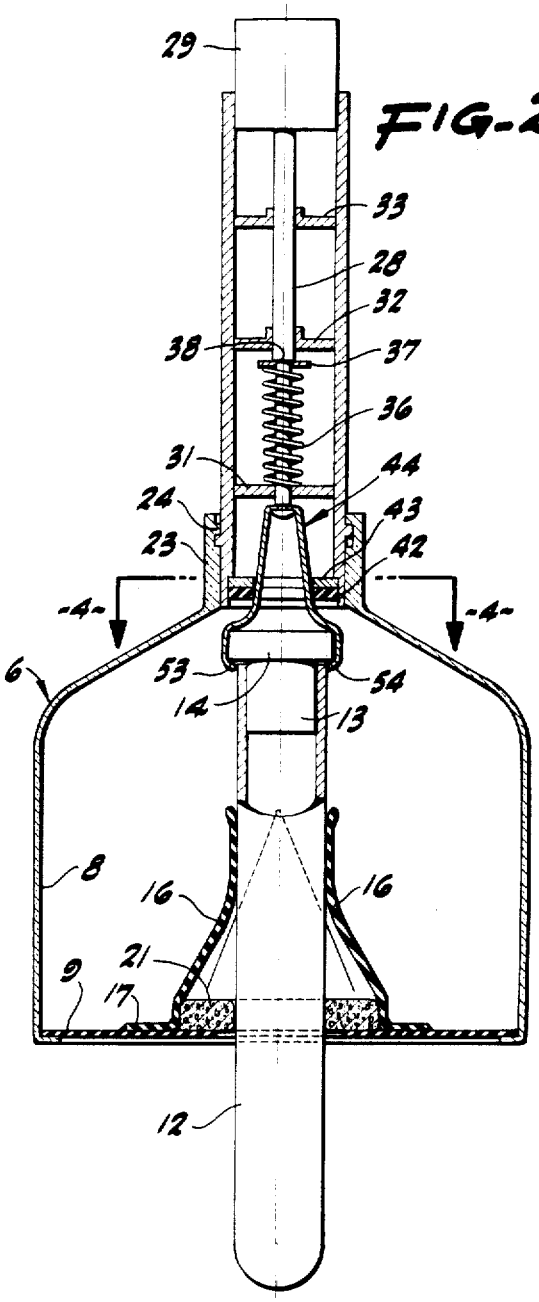
FIG-3
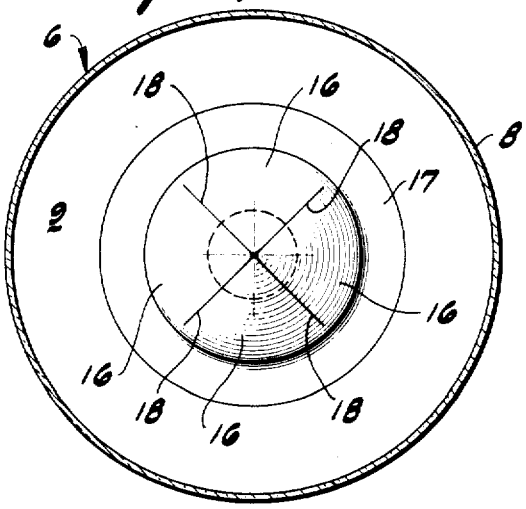
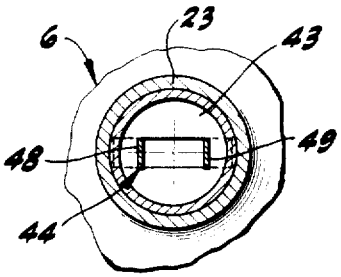
FIG-4

TEST TUBE CAP REMOVER

BRIEF SUMMARY OF THE INVENTION

For use with a cylindrical test tube having a cap with a flange there is provided an enclosure into which one portion of the capped test tube can be inserted through a seal for isolation from the atmosphere. Adjacent the cap the enclosure merges with a guide containing a thumb-actuated rod movable to close normally separated grippers onto the cap flange. The gripped cap and the exposed portion of the test tube are pulled apart to remove the cap from the test tube, any escaping material being confined to this enclosure. The separated tube and cap can then be removed from the enclosure.

PRIOR ART

U.S. Pat. Nos. 893,055, Conner; 1,596,960, Beccetti; 3,037,408, Rives et al.; 1,213,452, Brady; 2,718,801, Finley; 3,262,247, Scholle.

BRIEF DESCRIPTION OF THE SEVERAL VIEWS OF THE DRAWINGS

FIG. 1 is a view showing the device of the invention in position to receive a capped test tube. The view is composite, for the most part being in transverse cross-section on an axial plane, in part being in elevation and with a portion broken away to disclose some interior structure in elevation.

FIG. 2 is a view, like FIG. 1, showing the device in conjunction with a capped test tube.

FIG. 3 is a cross-section, the plane of which is indicated by the line 3—3 of FIG. 1.

FIG. 4 is a detail showing a portion of the structure in cross-section on the line 4—4 of FIG. 2.

DETAILED DESCRIPTION

In the handling of test tubes sealed with removable caps and containing blood for analysis, it is highly important to safeguard the individual doing the handling as well as the surroundings when the cap is removed from the test tube. That is because the blood may be contaminated with highly toxic materials. Removal of the cap is productive of a vacuum tending to volatilize the tube contents and permit escape of noxious or dangerous materials onto the handler and into the surroundings. For that reason, the persons who customarily handle the opening of test tubes are carefully protected. Even so, their laboratory surroundings are not protected from splatters and from air contamination.

In order to overcome these and other difficulties there is particularly provided an arrangement of considerably greater sanitary value.

The structure includes a somewhat deformable enclosure 6 ordinarily symmetrical about a longitudinal axis 7. The enclosure incorporates a clear or transparent plastic body 8 with an opaque rubber bottom 9 permanently joined together. There is a circular first opening 11 on the axis 7 through the bottom 9. The customary test tube 12 has a cap 13 with a flange 14 that is the same as or sometimes is larger in diameter than the outside of the test tube. The first opening 11 is of a diameter greater than that of the flange of the test tube cap.

On the inside of the enclosure 6, there is disposed a number of resilient or flexible or yielding leaves 16 upstanding from a base 17 merging with the bottom 9. The leaves when unstressed form a cone and are separated from each other by intervening cuts 18 that tend normally to be closed and preclude flow therethrough. When a test tube with its cap is moved axially through the first opening 11, the leaves are partially displaced from each other and in part lie closely against and conform to the sides of the test tube so as to inhibit leakage between the enclosure 6 and the atmosphere. When a test tube is absent, the leaves resiliently reassume their initial, closed position.

As a special precaution, within the circular base of the leaf assembly there is situated an annular sponge 21 yieldably receiving the cap and the test tube and preferably carrying a suitable disinfectant. The sponge serves not only as an additional seal against the atmosphere but also assists in preventing contamination.

The enclosure 6 has a conical upper portion terminating in a second opening 22 within a relatively stiff collar 23 upstanding symmetrically with the axis. The collar carries an internal thread 24 of a limited extent but sufficient to receive and support a similarly threaded cylinder 26. A half-turn or so rotation between the cylinder and the collar is sufficient to join them together firmly or to permit their axial separation. The cylinder 26 extends away from the enclosure and along the axis 7 carries within it an operating rod 28 at its upper end having a thumb button 29 slidable within the cylinder.

Near the enclosure 6 the cylinder 26 carries a guide plate 31 for the rod 28. Auxiliary guide plates 32 and 33 maintain the rod in central position. The guide plate 31 serves as a base for a coil spring 36, the other end of which seats against a washer 37 bearing against a shoulder 38 on the rod 28. The effect of the spring 36 is to urge the rod 28 away from the enclosure 6.

At one end the cylinder carries a seal washer 42 and an adjacent guide washer 43 both with rectangular openings. A gripper 44 is mounted on the lower end of the rod 28. This is preferably a strip of springy material formed into a tong configuration. In its central portion the gripper has an opening receiving the lower end of the rod 28. A rivet head 46 holds the parts in position. The gripper has inclined side members 48 and 49 extending through and adapted to cam against the guide washer 43. The side members 48 and 49 are extended to include spread portions 51 and 52 at their extremities inturned to afford hooks 53 and 54. The configuration and dimensions of the gripper are such that when the gripper is in a depressed, relaxed condition and with the spring 36 compressed, as shown in FIG. 1, the hooks 53 and 54 are spaced widely apart.

When the enclosure 6 is empty, as shown in FIG. 1, a test tube 12 and its cap 13 are introduced manually in an axial direction through the first opening 11. This deforms the sponge and spreads the leaves 16. The tube 12 is advanced until the cap 13 is in the vicinity of the gripper. The user, customarily with his fingers around the cylinder 26, depresses the button 29. This translates the rod 28, compresses the spring 36, and moves the gripper 44 farther into the enclosure 6 and to lie alongside the cap flange. Thereupon the test tube and cap are moved farther along the axis as pressure on the button 29 is reduced. The capped tube 12 and the gripper 44 move together. The side members 48 and 49 cam against the washer 43 as they move and despite their springiness are moved by the superior spring 36 and urged closer together. The hooks 53 and 54 ride under and engage with the lower face of the flange 14 of the cap. When a suitable engagement has thus been made, the test tube, gripped by the user, is withdrawn axially for a short distance. That motion leaves the cap held by the spring 36 in an upper position and permits the test tube manually to be pulled off of the cap. Even though the disconnection of those parts permits any aerosols or other materials to escape from the test tube, such escaped materials are nevertheless confined well within the enclosure.

The uncapped test tube can then be withdrawn between the leaves 16 and through the first opening 11 and can be subjected to the customary laboratory procedure. If it is particularly desired then to retrieve the cap 13, separately, after the tube is removed from the enclosure, the gripped cap, as shown in FIG. 2, can be withdrawn through the second opening 22 by twisting the cylinder 26 with respect to the collar 23, thus unscrewing the cylinder and permitting its axial disconnection from the enclosure 6. The cap accompanies the removed cylinder and can be retrieved.

In most cases, the uncapped test tube is reinserted into the enclosure 6 after the laboratory procedure has been completed, the tube being urged into snug reengagement with the cap, as appears in FIG. 2. At this juncture, the thumb button 29 is depressed, allowing the side members 48 and 49 to spread apart so that the hooks 53 and 54 are disengaged from the flange 14, thereby allowing the user to withdraw the capped test tube from the enclosure 6.

In an apparatus that is for a highly toxic use, it is preferred that some of the parts, particularly the enclosure 6, be made of relatively inexpensive materials. After one or a few uses the enclosure 6 and its parts can be thrown away and a new enclosure and parts can be substituted.

I claim:

1. A test tube cap remover for use with a test tube removably engaging a cap having a flange comprising means defining an enclosure having first and second openings disposed in alignment, yielding means continuous with said enclosure and surrounding said first opening for deflecting between a closed position and an open position, supporting means continuous with said enclosure and surrounding said second opening, a cap engaging means within said enclosure, means for mounting said cap engaging means on said supporting means for movement between a cap engaging and holding position and a cap releasing position, and means for moving said cap engaging means between said positions.

2. A device as in claim 1 in which said movement of said cap engaging means is linear and toward and away from said second opening.

3. A device as in claim 2 including means for resiliently urging said cap engaging means toward said second opening.

4. A device as in claim 2 in which said cap engaging means includes opposing gripper members movable toward and away from each other transversely of said linear movement.

5. A device as in claim 4 in which said gripper members are adapted to engage and underlie said cap flange.

6. A device as in claim 4 in which said gripper members are springs disposed apart from each other when unstressed.

7. A device as in claim 4 including means operated by said cap engaging means for moving said gripper members toward each other.

8. A test tube cap remover for use with a circular-cylindrical test tube extending along an axis and removably engaging a cap having a portion disposed in said test tube and having an extending flange, comprising:

a. means defining a deformable enclosure having first and second openings disposed in alignment on said axis;

b. means including resilient leaves continuous with said enclosure and surrounding said first opening within said container and disposed tightly to engage a test tube extending axially through said first opening;

c. a cylinder at one end engaging said enclosure and communicating with said second opening and extending along said axis;

d. means in said enclosure for engaging and releasing said cap; and, e. means in said cylinder and movable along said axis for operating said cap engaging and releasing means.

9. A device as in claim 8 including an annular sponge surrounding said first opening adjacent said leaves.

10. A device as in claim 8 in which said cap engaging and releasing means includes an axial push rod in said cylinder; a push button on said rod at the other end of said cylinder; and means for resiliently urging said push button to project from said other end of said cylinder.

* * * * *